United States Patent [19]

Lowe et al.

[11] Patent Number: 5,011,199

[45] Date of Patent: Apr. 30, 1991

[54] PANIC EXIT DEVICE HAVING AN EXIT-DELAYING MECHANISM

[75] Inventors: Peter E. Lowe, San Francisco; Peter H. Muller, Los Gatos, both of Calif.; Michael D. Coleman, Zionsville; Paul J. Haeck, Indianapolis, both of Ind.

[73] Assignee: Von Duprin, Inc., Indianapolis, Ind.

[21] Appl. No.: 458,194

[22] Filed: Dec. 28, 1989

[51] Int. Cl.[5] ..... E05C 3/08

[52] U.S. Cl. ..... 292/92; 292/DIG. 65

[58] Field of Search ..... 292/21, 92, 144, 201, 292/DIG. 65

[56] References Cited

U.S. PATENT DOCUMENTS 4,328,985 5/1982 Logan ..... 292/92 X 4,540,208 9/1985 Logan, Jr. et al. ..... 292/92 X

*Primary Examiner*—Richard E. Moore

*Attorney, Agent, or Firm*—Walter C. Vliet; Bernard J. Murphy

[57] ABSTRACT

A time-delayed mechanism obstructs movement of a latchbolt from its latched position to an unlatched position. Linkage coupled to the latchbolt, and manually acutated (by a push pad, or the like), includes an arm which normally pivots, with the manual actuation of the linkage. An initial, limited movement of the linkage activates a switch, and the latter activates a time delay circuit component. The latter component, following a specified time delay, interrupts power to a solenoid. The solenoid, normally powered, has a bar inductively movable therein with a rod joined thereto for coincident movement. An end of the rod carries a roller which intrudes into the pivotal arc of the arm, preventing full pivotable movement thereof. Consequently, the linkage, which is to move the latchbolt to its unlatched position is blocked until the time delay has run its course, whereupon the solenoid is de-energized. With deenergization of the solenoid, the bar, rod and roller are retracted, to permit full pivotal movement of the arm, and movement of the latchbolt to its unlatched position.

30 Claims, 6 Drawing Sheets

PANIC EXIT DEVICE HAVING AN EXIT-DELAYING MECHANISM

This invention pertains to door hardware, and in particular to panic exit devices such as those disclosed in U.S. Pat. Nos. 3,663,047; 3,730,574; and 4,741,563.

The aforesaid devices have a push bar substantially spanning the width of the door, or the like, to which it is mounted, for movement toward the door and translation or actuation of linkage in order to retract a latchbolt. Such devices are panic exit devices, in that they immediately release the latchbolt and provide rapid egress. There are circumstances, however, in which an immediate and rapid egress is not desirable.

In retail stores, for instance, it is frequently desirable to introduce a delayed egress, in that shop-lifting is so widespread. Consequently, if the exiting can be delayed for a brief period of time, fifteen or twenty seconds, perhaps, and an audible signal emitted when the panic exit device is pushed, it will afford the store personnel an opportunity to monitor the exiting party.

Too, in hospitals and/or nursing homes, there need to be secure exits which, for reasons of safety, will afford exiting but, also, will briefly delay such just long enough so that responsible attendants can ascertain the competence of those using the exit. If ill or disoriented persons operate a panic exit device, and can be delayed long enough for a signal to be sounded, they can be prevented from putting themselves in harm's way.

It is an object of this invention to meet the aforesaid need for panic exit devices which have exit-delaying mechanisms: in the builders' hardware industry such mechanisms are referred to as Special Locking Arrangements. It is particularly an object of this invention to set forth a panic exit device having an exit-delaying mechanism comprising a frame; a latchbolt mounted to said frame for movement relative thereto between a first, latched position, and a second, unlatched position; manually-actuated linkage means, linked to said latchbolt and movably mounted to said frame, for moving said latchbolt from said first position to said second position; first means mounted to said frame, and movable relative to said frame between a first disposition thereof (a) for obstructing movement of said linkage means, and a second disposition thereof (b) for unobstructing movement of said linkage means; and second means mounted to said frame operative in response to, and with a specific time delay following, manual actuation of said linkage means, for moving said first means from said disposition thereof to said second disposition thereof.

It is also an object of this invention to disclose a panic exit device having an exit-delaying mechanism comprising a first, frame means for housing the mechanism; a latchbolt mounted to said first, frame means for movement relative thereto between a first, latched position, and a second, unlatched position; second, linkage means, manually-actuated, linked to said latchbolt, and movably mounted to said first, frame means, for moving said latchbolt from said first position to said second position; blocking means mounted to at least one of said first and second frame and linkage means, and movable relative to one of said first and second means (a) for obstructing movement of said linkage means, in a first disposition of said blocking means, and (b) for obstructing movement of said linkage means, in a second disposition of said blocking means; and release means mounted to said first, frame means and operative in response to, and with a specific time delay following, manual actuation of said linkage means, for moving said blocking means from said first disposition thereof to said second disposition thereof.

Further objects of this invention, as well as the novel features thereof, will become more apparent by reference to the following description taken in conjunction with the accompanying figures, in which:

FIG. 1 is side elevational view thereof, albeit omitting the push pad, with the pivotal arm shown in cross-section, showing the linkage blocked;

FIG. 2 is a plan view of a portion thereof;

FIG. 3 is a view like that of FIG. 1 showing the linkage unblocked;

FIG. 4 is a perspective, detailed view of the linkage-mounted time delay switch;

FIG. 5 is an exploded, perspective illustration of the linkage-obstructing components; and FIG. 6 is a cross-sectional view taken along section 6—6 of FIG. 1.

FIG. 7 is a perspective view, and FIG. 8 is a side elevational view thereof.

FIG. 9 is a view like that of FIG. 1;

FIG. 10 is a view like that of FIG. 3;

FIG. 11 is a perspective, exploded view of the linkage blocking or obstructing means; and FIG. 12 is a cross-sectional view taken along section 12—12 of FIG. 9.

Figure 13:
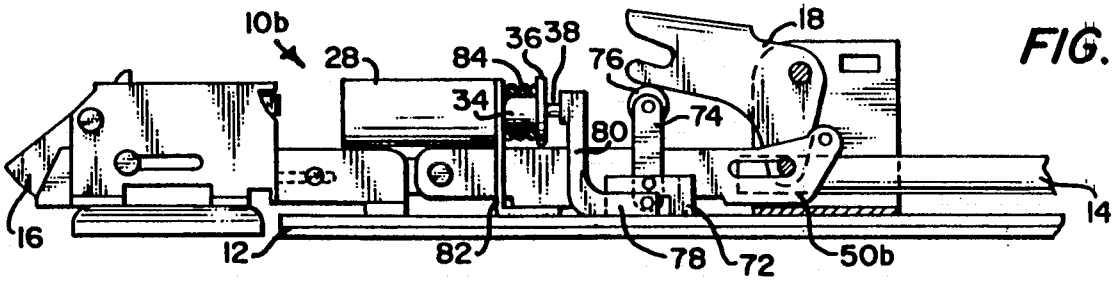
FIGS. 13 through 16 illustrate another embodiment of the novel panic exit device.
Figure 14:
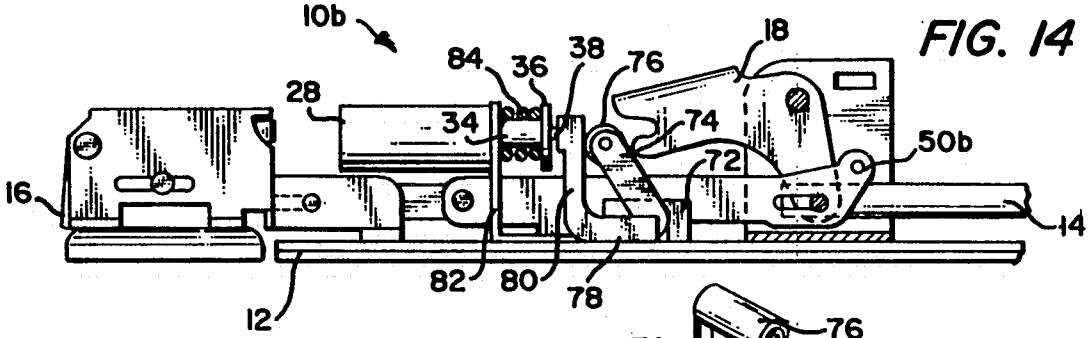
Figure 15:
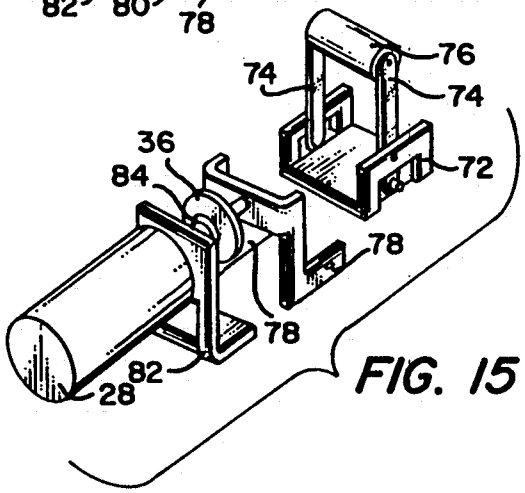

FIGS. 13 and 14 are views corresponding to FIGS. 1 and 3, and 9 and 10;

FIG. 15 is a perspective, exploded view thereof; and

Figure 16:
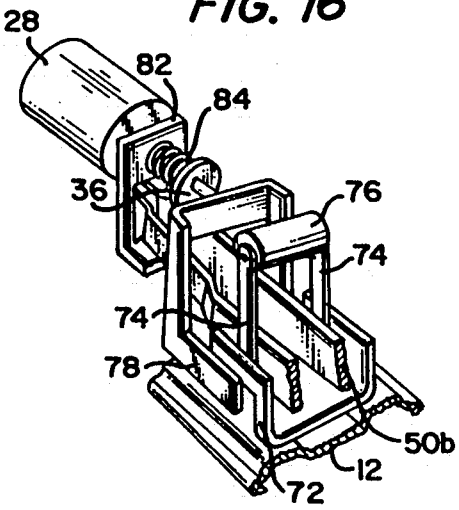

FIG. 16 is an assembled, perspective view.

Figure 17:
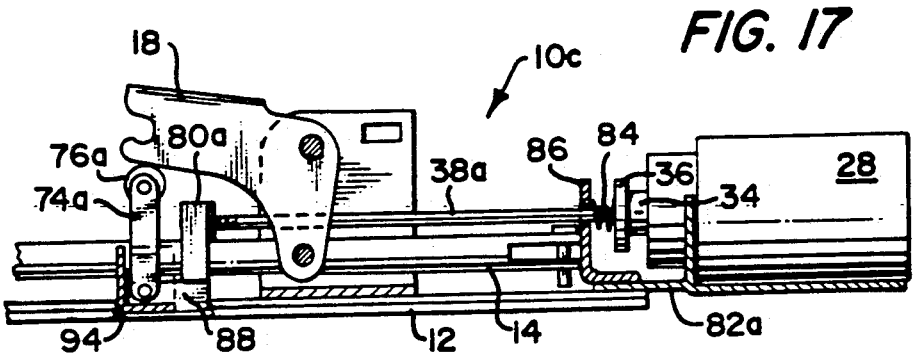
Figure 18:
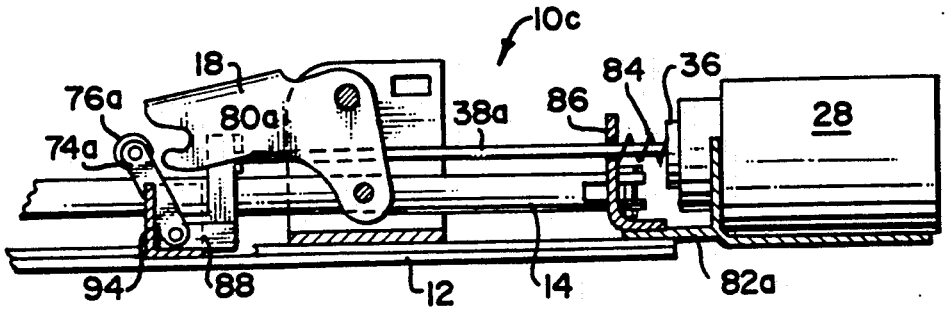
Figure 19:
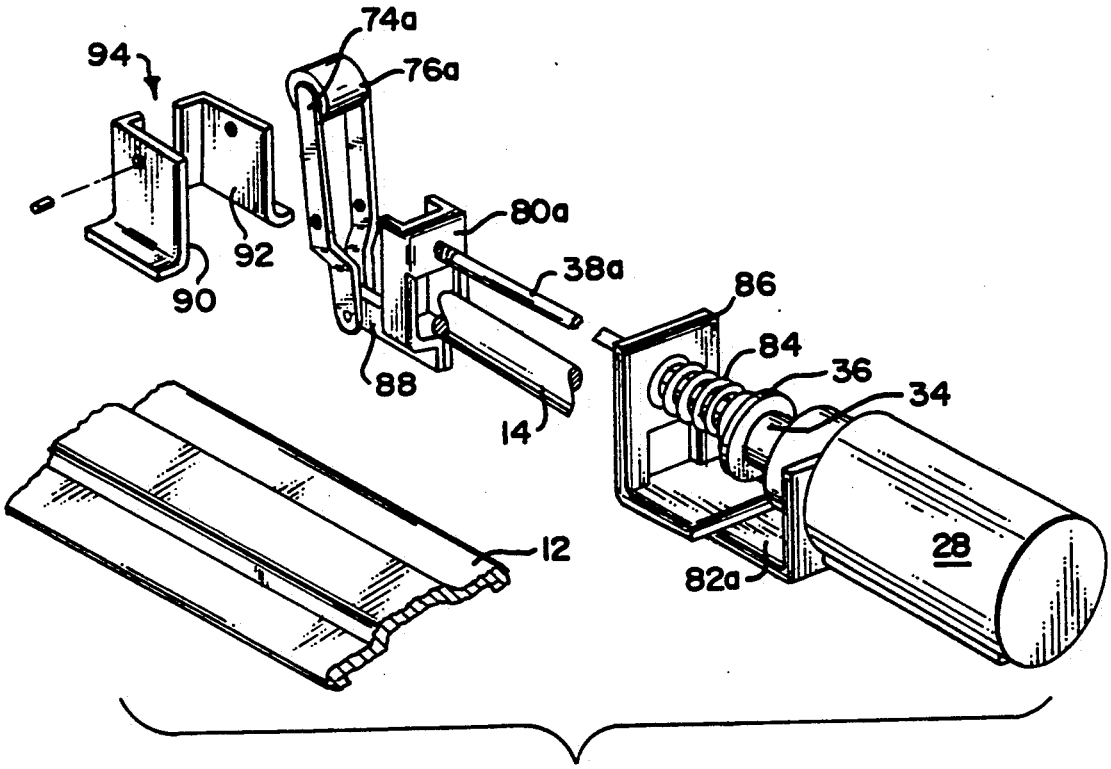

FIGS. 17 through 19 depict yet another embodiment of the invention.

FIGS. 17 and 18 correspond to the views of FIGS. 1 and 3, 9 and 10, and 13 and 14; and FIG. 19 is an exploded, perspective view of the linkage blocking means of this embodiment.

Figure 20:
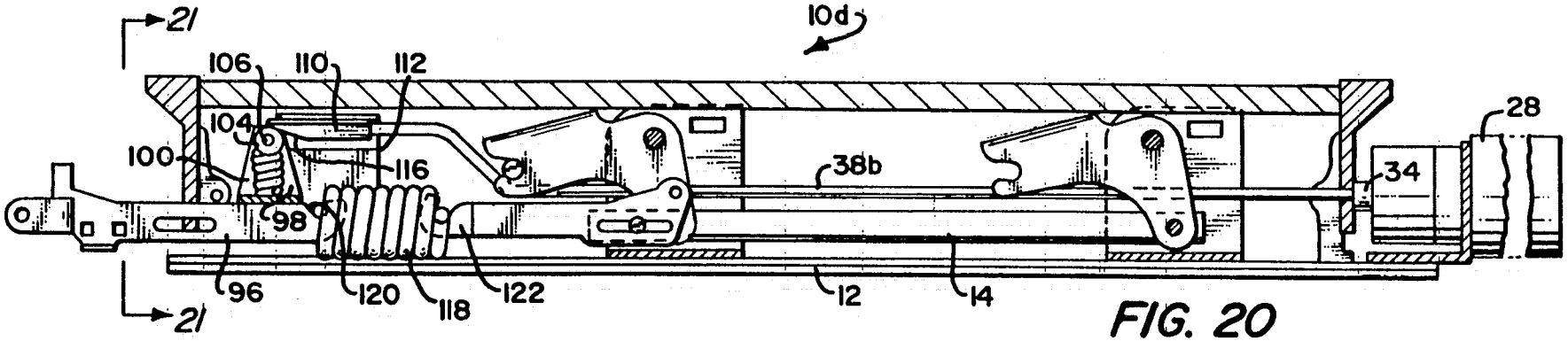
Figure 22:
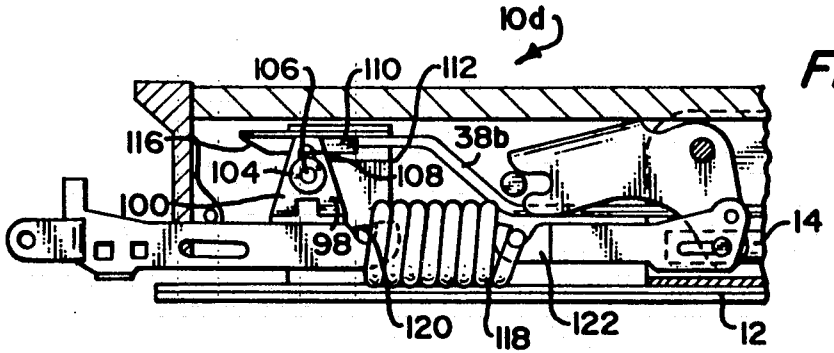
Figure 21:
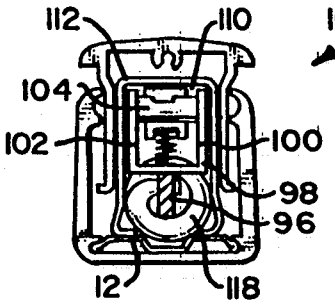

FIGS. 20 through 22 are depictions of still a further embodiment of the invention.

Figure 1:
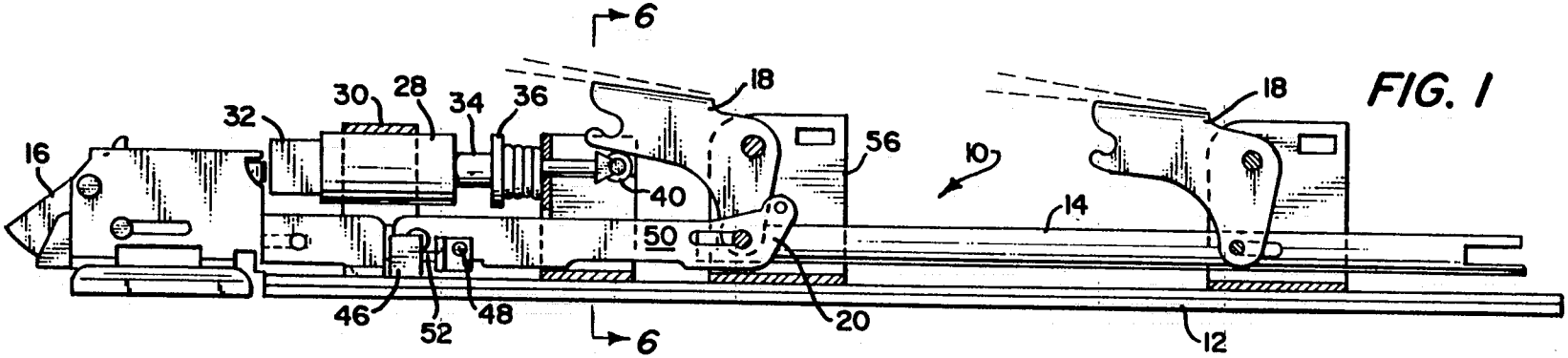
Figure 3:
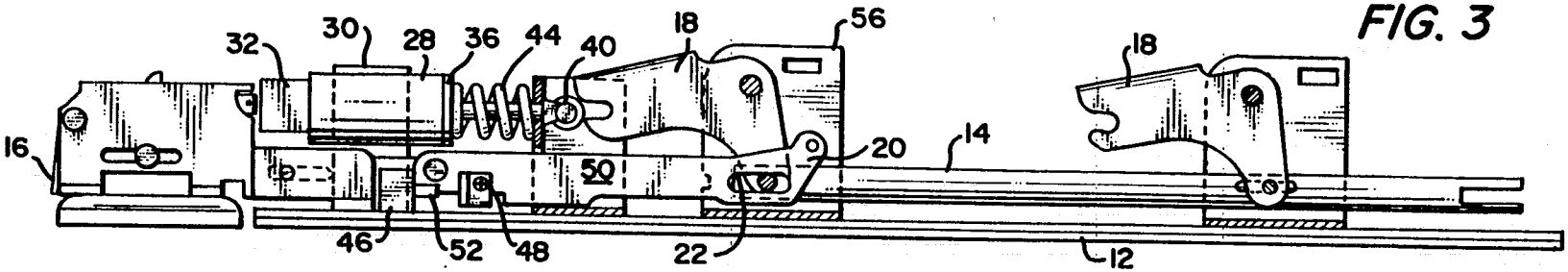
Figure 4:
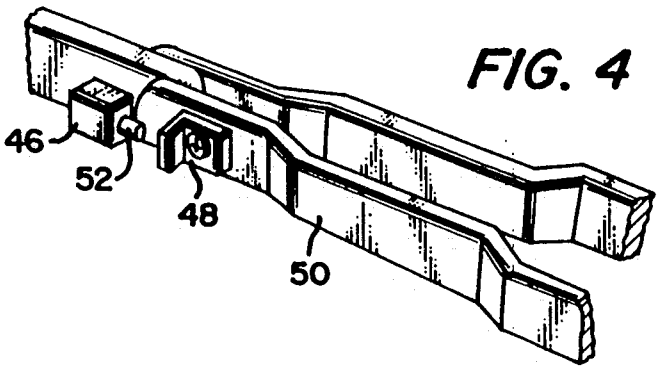
Figure 9:
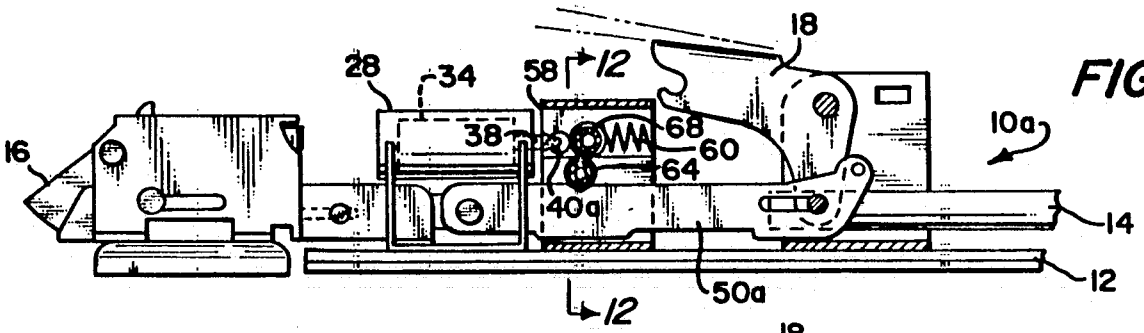
FIGS. 9 through 12 are depictions of a further embodiment of the invention.
Figure 10:
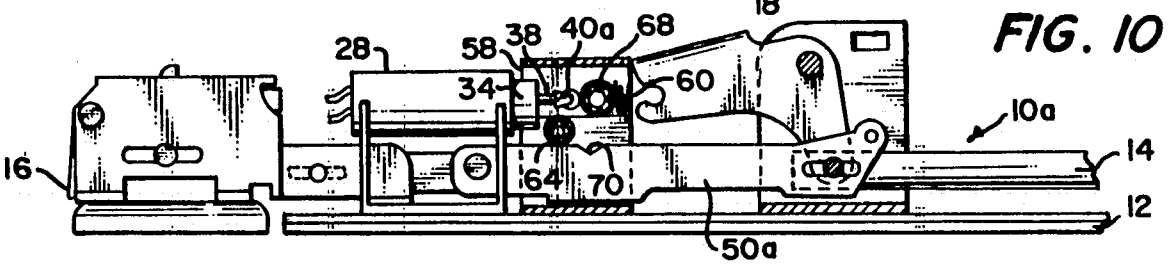
Figure 11:
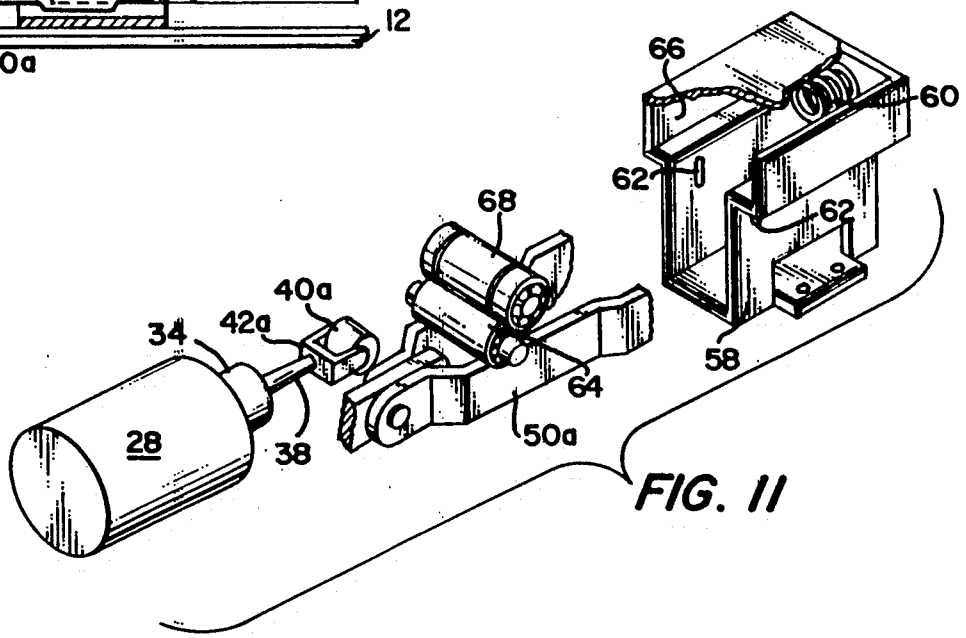
Figure 12:
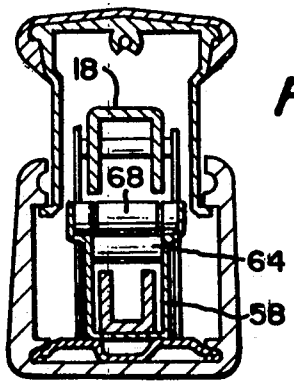
Figure 23:
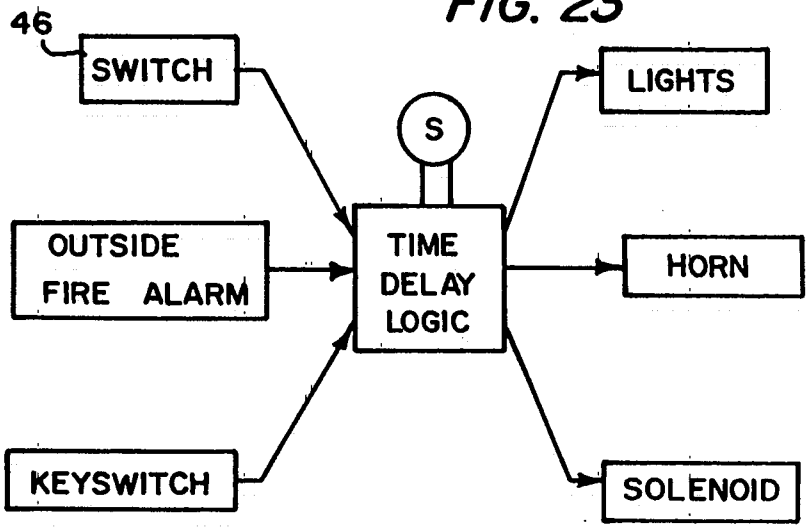

FIG. 20 is a side elevational view; it corresponds to FIGS. 1, 9 and 13;

FIG. 21 is a cross-sectional view taken along section 21—21 of FIG. 20;

FIG. 22 is a side elevational view of a portion of the device, which corresponds generally to FIGS. 3, 10 and 14; and FIG. 23 is a block diagram showing the relationship between the time delay circuit component and switch therefor, the solenoid, and ancillary elements.

In each of the embodiments of the invention, the panic exit devices depicted, absent the exit-delaying mechanisms thereof, are constructed, and function, quite like those well-known in the prior art, and as disclosed in the aforesaid U.S. Pat. Nos. 3,663,047; 3,730,574; and 4,741,563. Accordingly, for a fuller understanding of the basic panic exit device, said patents are incorporated herein by reference, and detailed explanations of the functioning of such are deemed not necessary.

Figure 6:
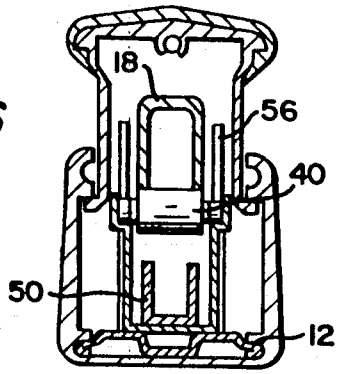
FIG. 1 through 6 depict a first embodiment of the novel panic exit device according to the invention.
Figure 2:
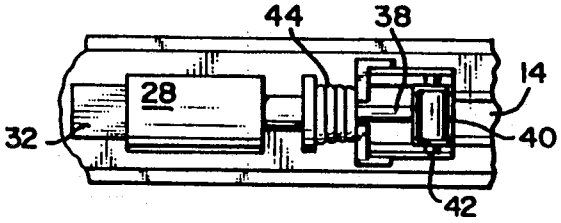

As shown in FIGS. 1 through 6, a first embodiment of the novel panic exit device, with exit-delaying mechanism, comprises a base or frame 12 and manually-actuated linkage 14 movably mounted on the frame 12. The linkage 14 is coupled to a latchbolt 16 in order to move the latter from a latched position thereof, as shown in FIG. 1 to an unlatched position thereof, as shown in FIG. 3. The linkage is moved, from left to right (as viewed in FIGS. 1 and 3), by means of right-angular arms 18 which are pivotably mounted on the frame 12; the arms 18 have a push pad (as shown in FIG. 6), or the like, coupled thereto for manual actuation.

With a manual push pad, the arms 18 pivot, move the linkage 14, and retract the latchbolt 16.

The aforesaid simply explains the normal or conventional functioning of the known panic exit devices. What follows explains how an initial, limited motion of the linkage 14 is employed to initiate an exit delay.

Mounted to the frame 12 is a bracket 24 which has a slot 26 in an upstanding wall thereof. Too, a solenoid 28 is mounted to the frame 12 by means of a clamp 30. A time-delay circuit component 32 is coupled to the rear of the solenoid 28, the same being electrically linked therewith (see FIG. 23). The solenoid 28 has the customary, inductively movable bar 34 therein which is joined, through a flange 36, to a rod 38. The end of the rod 38 mounts a roller 40 in a bifurcated carrier 42. The rod is slidably engaged with the slot 26 in the wall of the bracket 24 and has a compression spring 44 set thereabout; ends of the spring 44 are engaged with the flange 36 and the aforesaid wall. A switch 46 is fixed to the frame 12 and a lug 48 is fixed to a link 50 of the linkage 14.

The switch 46 has an exposed actuator 52 which, with movement of the linkage 14, is engaged and disengaged by the lug 48. The switch 46 is electrically coupled to the time delay circuit component 32, and the latter is electrically coupled to the solenoid 28 (FIG. 23).

Under normal circumstances, the door (or the like) to which the device 10 is mounted is closed, and the latchbolt 16 is in its latched position - -as shown in FIG. 1. Also, the solenoid 28 is energized by the source "S" (FIG. 23) of power and, as a consequence thereof, the bar 34, rod 38, roller 40 and carrier 42 are extended, as shown in FIG. 1. The lug 48 is engaged with the actuator 52. With movement of the linkage 14, pursuant to a manual push on the push pad, the link 50 moves concomitantly, and the lug 48 fixed thereto withdraws from the switch 46 and its actuator 52. Resultantly, the switch 46 functions to initiate the time delay of the circuit component 32. Then, for purpose of this disclosure, the time delay imposed on the opening of the door will be understood to be fifteen seconds.

Clearly, the arms 18 cannot slue through their full, pivotable motion, due to the obstruction of the roller 40. Therefore, although one has depressed the push pad, the latchbolt 16 cannot be retracted. The limited, initial motion of the linkage 14 has only actuated the switch 46 and started the time delay. Until the specified delay has run it course, the roller 40 remains in obstruction of the arms 18. At this time, an audible alarm and/or a visual alarm (FIG. 23), electrically coupled to the circuitry, will give a sensible signal of an attempt at the opening of the door. Responsible personnel can hurry to the door to ascertain who is trying to exit.

When the time delay has run its course, the circuit component 32 interrupts the power to the solenoid 28, and the spring 44 retracts the bar 34, rod 38 and roller 40. Now the door may be opened. The arms 18 are unobstructed, and they may slue through their full, pivotal arcs to translate the linkage 14 fully and retract the latchbolt 16.

In this embodiment of the invention, the time delay circuit component 32 is shown mounted to the solenoid 28. Now, this is arbitrary; it may be remotely mounted, if desired, as it has only to be electrically, not physically, coupled to the solenoid 28 and the switch 46.

Figure 8:
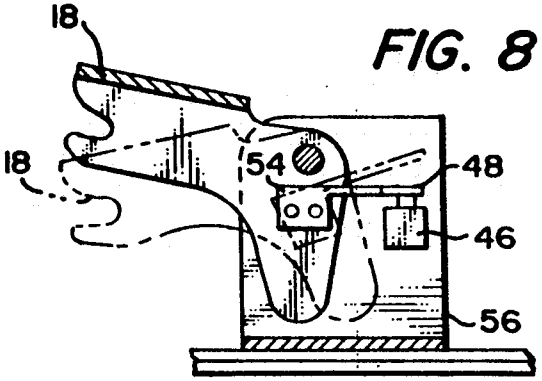
FIG. 7 and 8 are but fragmentary views of an alternate embodiment in which the time-delay switch is mounted to the frame structure.
Figure 7:
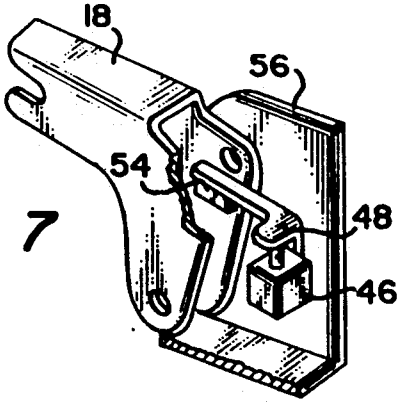
Figure 5:
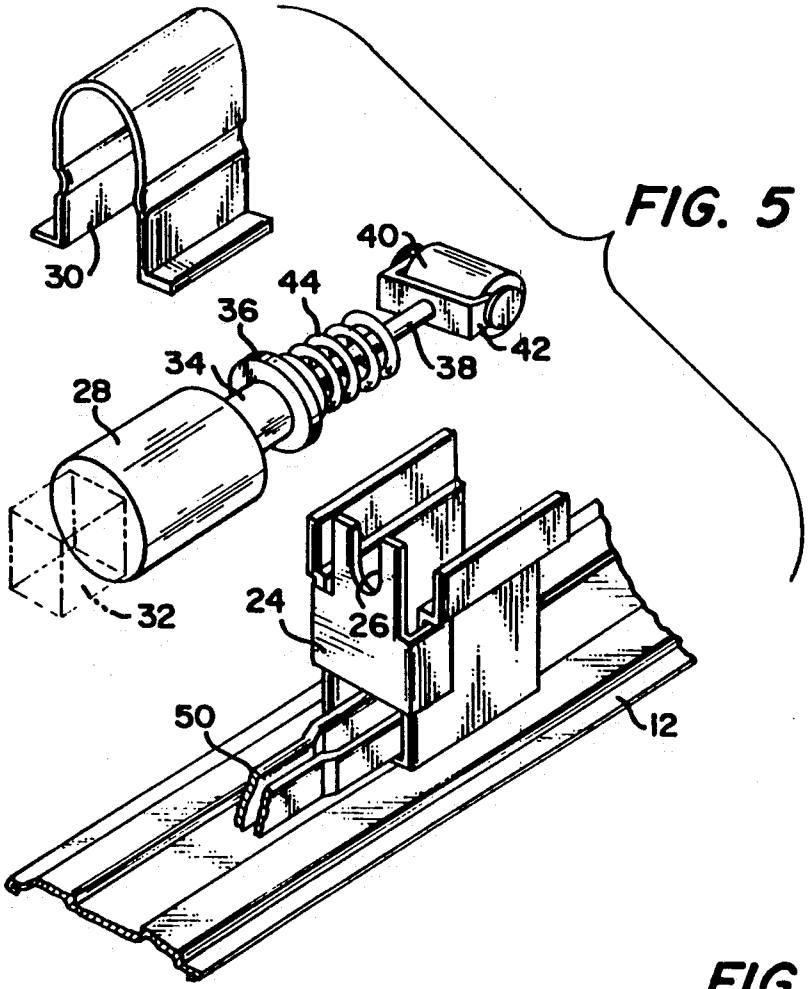

Similarly, the switch 46 and lug 48 may be otherwise located, as the alternative embodiment of FIGS. 7 and 8 shows. Here, the lug 48 is carried by an arm 54 which is fixed to one of the pivotable arms 18, and the switch 46 is fastened to a frame member 56 to which the arm 18 is pivotably mounted.

It can be seen that the latchbolt 16, in its latched position, is extended, outwardly, from the frame 12, and in its unlatched position is retracted, and substantially confined, within the frame 12. Too, the linkage 14 is not articulated; it moves only lengthwise of the frame 12. Together, however, the linkage 14 and the arms 18 comprise the manually-actuated means for moving the latchbolt 16 between its latched and unlatched position.

The embodiment 10*a* of FIGS. 9 through 12 serves the same exit-delaying function, but in a different manner. While not shown, it is to be understood that in this embodiment, also, a time delay circuit component 32, switch 46 and lug 48 are employed.

Embodiment 10*a* comprises a four-sided bracket 58 mounted to the frame 12. The bracket has a compression spring 60 fixed therein; it is fastened at one end to a rear wall thereof. Too, the bracket has a pair of parallel slots 62 formed in side walls thereof in which is received the pin ends of a roller 64. The uppermost portion of the bracket defines a sort of trough 66 in which another roller 68 is supported. The other end of the spring, which is in the bracket 58, is attached to roller 68. A link 50*a*, corresponding to link 50 (of embodiment 10), has a V-shaped groove 70 formed therein. In this embodiment, the solenoid 28 has the bar 34, rod 38, carrier 42*a* and roller 40*a*. However, herein, with the power on, i.e., with the solenoid energized the bar 34 is held retracted. Consequently, the spring 60 holds the roller 68, in the trough 66, atop the roller 64. In this latched positioning of the latchbolt 16, the roller 64 is bottomed in the slots 62 and seated in the groove 70 (FIG. 9). As a consequence, the linkage 14 cannot be retracted; roller 68 prevents roller 64 from rising from the groove 70 along the slots 62.

Again, as in embodiment 10, the time delay function operates, after the specified fifteen second delay, to cut off the power to the solenoid 28. Consequently, now the bar 34 is released and extends to move the rod 38 carrier 42*a* and roller 40*a* to the right (as viewed in FIG. 10) to displace the roller 68. The roller 64 is freed from the groove 70 and rises along the slots 62. As a result, the linkage is unblocked; link 50*a* and its related linkage 14 can respond to the pivoting of the arms 18 and retract the latchbolt 16.

The embodiment 10*b* of FIGS. 13 and 14 also employs a roller to block the slue of arm 18—one of the arms 18, albeit in a different fashion. A bracket 72 is set astride, and beneath a link 50*b*. The bracket 72 has a pair of arms 74 pivotably mounted thereto which, in turn, carry a roller 76 at outermost ends thereof. The other, innermost ends of the arms 74 are pivotably mated to parallel limbs 78 of a fork 80. Fork 80 is carried by the rod 38 which, through the flange 36, is joined to the bar 34 of the solenoid 28. The solenoid 28 is mounted to the frame 12 by means of a brace 82. A compression spring 84 is set about the bar 34 and bears between the flange 36 and the brace 82. Herein, with power on to the solenoid, i.e., with the solenoid energized, the bar 34 and rod 38 are retracted, and the fork 80 holds the arms 74 upright; consequently, the roller 76 obstructs the arm 18, preventing translation of the linkage 14 and retraction of the latchbolt 16. The switch 46 (not shown here), again, responds to the initial, limited movement of the linkage and arms 18 to activate the time delay circuit component 32 (not shown here). After the specified time delay, of fifteen seconds, the circuit component 32 de-energizes the solenoid 28. The spring 84 pushes the flange 36 to the right (as viewed in FIG. 14) to advance the fork 80. The latter, in turn, causes the arms 74 to tilt and slue the roller 76 away from the arm 18. Now the arm can pivot through its full arc, translate the linkage 14, and retract the latchbolt 16.

An alternative embodiment 10*c*, shown in FIGS. 17 through 19, is substantially similar to embodiment 10*b*, except that it is mounted adjacent to the arm 18 which is furtherest from the latchbolt 16. In this embodiment 10*c*, the solenoid 28 is mounted to the frame 12 by means of a brace 82*a*. The bar 34 is coupled to a rod 38*a*, via a flange 36, and the rod 38*a* penetrates a bracket 86. A compression spring 84 is set about the rod 38*a* between the frame-mounted bracket 86 and the flange 36. A remote end of the rod 38*a* is threadedly engaged with a fork 80*a*, and the latter has an extending limb 88 to which ends of parallel limbs 74*a* are pivotably joined. The other ends of the limbs 74*a* rotatably carry a roller 76*a*. Intermediate the lengths thereof, the limbs 74*a* are pivotably coupled to the side walls 90 and 92 of a bracket 94 which is fastened to the frame 12.

With the solenoid 28 energized, as a normal condition of the device 10*c*, the bar 34 and rod 38*a* are advanced and, as a consequence, the limbs 74*a* are held upright to dispose the roller 76 in blocking engagement with the arm 18. Through the action of the switch (46, not shown) and time delay circuit component (32, not shown), power is cut off to de-energize the solenoid, after the fifteen second delay. The spring 84 reacting from the bracket 86, pushes the flange 36 and the bar 34 to the right (as viewed in FIG. 18). This causes the fork 80*a* to tilt the limbs 74*a* and withdraw the roller 76 from blocking engagement with the arm 18.

Yet another embodiment 10*d*, shown in FIGS. 20 through 22, exhibits a further means for time-delaying the release of the panic exit linkage (and latchbolt). In this embodiment 10*d*, a link 96 has fixed thereupon a bracket 98. The latter has a pair of parallel arms 100 and 102 which carry a roller 104 therebetween. The roller has a pin 106 therein which is slidable through slots 108 formed in the arms 100 and 102. A compression spring is set within the bracket 98 to urge the roller 104 and pin 106 to the topmost portions of the slots 108. In this positioning, the roller engages an abutment 110 which is fixed in a bracket 112 which is set about the bracket 98 and is fixed to the frame 12. The solenoid 28 is mounted to the frame 12 by means of a brace 114. The bar 34 thereof is joined to an extended limb 38*b*; at the other end of the limb 38*b* is a tapered ramp 116.

The ramp 116, in the circumstance wherein the solenoid is energized (as shown in FIG. 20) is set upon the roller 104; it is interposed between the roller 104 and a top a wall of the bracket 112. In this condition, the linkage 14 cannot retract as the roller 104, carried via the bracket 98, cannot get past the abutment 110. However, the aforesaid same time delay switch 46 and time delay circuit component 32 (neither of which are shown here) cause the solenoid to lose power, after fifteen seconds. Resultantly, the bar 34 and limb 38*b* are advanced toward the bracket 112. As it is constrained by the top wall of the bracket 112, the limb 38*b* forces the ramp 116 across the roller 104. This causes the roller 104, and its pin 106 to travel down through the slots 108, in avoidance of the abutment 110, to free the linkage 14 for translation.

The linkage 14, as shown in FIGS. 20–22, is interrupted from directed mechanical connection by a large, extension spring 118. The innermost end of the link 96 has a hook-like recess 120 in which is coupled one end of the spring 118, and a like coupling at the other end is effected with a link 122. It is not uncommon for persons to impact the push pads with great, unnecessary force. To insure that the mechanism will not be damaged, the spring 118 is provided. In resistance to the bias of the spring, the latter will extend, putting a greater distance between the links 96 and 122. The link 96 will not translate unless and until the roller 104 is displaced from the abutment 110, as noted above. But the link 122 will move, it and the spring 118 taking up the force applied to the push as a dampering agency.

While we have described our invention in connection with specific embodiments thereof it is to be clearly understood that this is done only by way of example, and not as a limitation to the scope of the invention as set forth in the objects thereof and in the appended claims. For instance, the invention provides for an overriding of the delay function by means of a key-switch, for use only by responsible personnel, and for immediate, automatic overriding of the aforesaid function by an outside fire alarm signal (see FIG. 23) in accordance with applicable fire codes.

We claim:

1. A panic exit device having an exit-delaying mechanism, comprising:

an elongated frame;

a latchbolt mounted to said frame for movement relative thereto between a first, latched position in extension, outwardly, from said frame, and a second, unlatched position retracted, and substantially confined, within said frame;

manually-actuated linkage means having (a) a linkage coupled to said latchbolt and mounted to said frame for movement relative to, and only lengthwise of, said frame, for moving said latchbolt from said first position to said second position, and (b) an arm, pivotally mounted to said frame, and coupled to said linkage, for moving said linkage lengthwise of said frame;

first means mounted to said frame, and movable relative to said frame between a first disposition thereof (a) for obstructing movement of said linkage means, and a second disposition thereof (b) for obstructing movement of said linkage means; and second means mounted to said frame operative in response to, and with a specific time delay following, manual actuation of said linkage means, for moving said first means from said first disposition thereof to said second disposition thereof.

2. A panic exit device having an exit-delaying mechanism, comprising:

a frame;

a latchbolt mounted to said frame for movement relative thereto between a first, latched position, and a second unlatched position;

manually-actuated linkage means, linked to said latchbolt and movably mounted to said frame, for moving said latchbolt from said first position to said second position;

first means mounted to said frame, and movable relative to said frame between a first disposition thereof (a) for obstructing movement of said linkage means, and a second disposition thereof (b) for unobstructing movement of said linkage means; and second means mounted to said frame operative in response to, an with a specific time delay following, manual actuation of said linkage means, for moving said first means from said first disposition thereof to said second disposition thereof; wherein said linkage means comprises an arm pivotably mounted to said frame for movement thereof through a given arc;

said first comprises an element which normally intrudes into said arc to prevent pivotable movement of said arm therethrough;

said element is coupled to a limb; and said second means comprises means for moving said limb to cause said element to withdrawn from said arc.

3. A panic device, according to claim wherein:

said limb-moving means comprises a compression spring.

4. A panic exit device, according to claim 1, wherein:

said linkage means comprises an arm pivotably mounted to said frame for pivotable movement thereof through a given arc; and said first means comprises a solenoid-operated, translatable element which is movable in a first axial direction for intrusion into said arc, and movable in a second axial direction for withdrawal thereof from said arc.

5. A panic exit device having an exit-delaying mechanism, comprising:

a frame;

a latchbolt mounted to said frame for movement relative thereto between a first, latched position, and a second, unlatched position;

manually-actuated linkage means, linked to said latchbolt and movably mounted to said frame, for moving said latchbolt from said first position to said second position;

first means mounted to said frame, and movable relative to said frame between a first disposition thereof (a) for obstructing movement of said linkage means, and a second disposition thereof (b) for unobstructing movement of said linkage means; and second means mounted to said frame operative in response to, and with a specific time delay following, manual actuation of said linkage means, for moving said first means from said first disposition thereof to said second disposition thereof; wherein said linkage means comprises an arm pivotably mounted to said frame for movement thereof trough a given arc;

said second means comprises a solenoid with a bar inductively movable therein;

said first means comprises a rod coupled to said bar, and a roller carried by said rod;

said solenoid has a first, energized mode of operation, and a second, de-energized mode of operation; and said solenoid, in one of said modes of operation, moves said bar, rod and roller to cause said roller to intrude into said arc to prevent pivotable movement of said arm.

6. A panic exit device, according to claim 5, wherein:

said second means further includes retracting means for moving said bar, rod and roller, to cause said roller to withdraw from said arc, in response to an operation of said solenoid in a mode other than said one mode of operation.

7. A panic exit device, according to claim 6, wherein:

said frame has a bracket fixed thereon;

said retracting means comprises a compression spring;

said bar and rod have a flange fixed therebetween; and said springs is in circumscription of said rod, and ends thereof bear against said flange and said bracket.

8. A panic exit device, according to claim 5, wherein:

said second means further comprises a time delay circuit component electrically coupled to said solenoid, and a switch, having an exposed actuator, electrically coupled to said component, for activating and deactivating said component;

said switch is mounted to said frame; and further including a lug, coupled to said linkage, disposed for engagement and disengagement with and from said actuator.

9. A panic exit device, according to claim 5, wherein:

said second means further comprises a time delay circuit component electrically coupled to said solenoid, and a switch, having an exposed actuator, electrically coupled to said component, for activating and deactivating said component;

said switch is mounted to said frame; and further including a lug, coupled to said arm, disposed for engagement with, and disengagement from, said actuator.

10. A panic exit device having an exit-delaying mechanism, comprising:

a frame;

a latchbolt mounted to said frame for movement relative thereto between a first, latched position, and a second unlatched position;

manually-actuated linkage means, linked to said latchbolt and movably mounted to said frame, for moving said latchbolt from said first position to said second position;

first means mounted to said frame, and movable relative to said frame between a first disposition thereof (a) for obstructing movement of said linkage means, and a second disposition thereof (b) for unobstructing movement of said linkage means; and second means mounted to said frame operative in response to, and with a specific time delay following, manual actuation of said linkage means, for moving said first means from said first disposition thereof to said second disposition thereof; wherein said linkage means comprises an arm pivotably mounted to said frame for movement thereof through a given arc;

said first means comprises an element which normally intrudes into said arc to prevent pivotable movement of said arm therethrough;

said element is coupled to said first ends of parallel limbs;

said limbs are pivotably mounted to said frame intermediate the ends thereof; and second ends of said limbs are coupled to a solenoid-operated, translatable bracket which is movable in a first, given direction to pivot said limbs and cause said element to intrude into said arc, and movable in a second, opposite direction to pivot said limbs to cause said element to withdraw from said arc.

11. A panic exit device having an exit-delaying mechanism, comprising:

a frame;

a latchbolt mounted to said frame for movement relative thereto between a first, latched position, and a second, unlatched position;

manually-actuated linkage means, linked to said latchbolt and movably mounted to said frame, for moving said latchbolt from said first position to said second position;

first means mounted to said frame, and movable relative to said frame between a first disposition thereof (a) for obstructing movement of said linkage means, and a second disposition thereof (b) for unobstructing movement of said linkage means; and second means mounted to said frame operative in response to, and with a specific time delay following, manual actuation of said linkage means, for moving said first means from said first disposition thereof to said second disposition thereof; wherein said linkage means comprises an arm pivotably mounted to said frame for movement thereof through a given arc;

said first means comprises an element which normally intrudes into said arc to prevent pivotable movement of said arm therethrough;

said second means comprises a solenoid with a bar inductively movable therein;

said first means comprises a bracket coupled to said bar for coincident movement therewith;

said first means further includes a pair of limbs, disposed in parallel, and pivotably mounted to said frame intermediate the ends of said limbs; and first ends of said limbs support said element therebetween, and second ends of said limbs are pivotably coupled to said bracket.

12. A panic exit device, according to claim 11, further including:

means biasing said bar in a given disposition relative to said solenoid.

13. A panic exit device having an exit-delaying mechanism, comprising:

a frame;

a latchbolt mounted to said frame for movement relative thereto between a first, latched position, and a second, unlatched position;

manually-actuated linkage means, linked to said latchbolt and movably mounted to said frame, for moving said latchbolt from said first position to said second position;

first means mounted to said frame, and movable relative to said frame between a first disposition thereof (a) for obstructing movement of said linkage means, and a second disposition thereof (b) for unobstructing movement of said linkage means; and second means mounted to said frame operative in response to, and with a specific time delay following, manual actuation of said linkage means, for moving said first means from said first disposition thereof to said second disposition thereof; wherein said linkage means comprises an arm pivotably mounted to said frame, and a latchbolt link pivotably coupled to said arm for translation thereof in response to pivotable movement of said arm;

said link has a discontinuity thereon; and said first means comprises an element coupled to said frame and movable relative to said frame between a first disposition thereof, in which said element is engaged with said discontinuity to prevent translation of said link, and a second disposition thereof wherein said element is disengaged from said discontinuity, and means movably mounted in said frame for engaging said element to prevent movement of said element from said first disposition thereof to said second disposition.

14. A panic exit device, according to claim 13, wherein:

said element engaging means comprises a cylinder, and means biasingly maintaining said cylinder in engagement with said element.

15. A panic exit device, according to claim 13, wherein:

said second means comprises means for moving said cylinder out engagement with said element.

16. A panic exit device, according to claim 14, wherein:

said second means comprises a solenoid with a bar inductively movable therein, a rod coupled to said bar for coincident movement therewith, and a pusher mounted on an end of said rod, and engaged with said cylinder.

17. A panic exit device, according to claim 16, wherein:

said solenoid has a first, energized mode of operation, and a second, de-energized mode of operation and, in one of said modes of operation, moves said bar, rod and pusher to cause said pusher to move said cylinder out of engagement with said element.

18. A panic exit device having an exit-delaying mechanism, comprising:

first, elongated frame means for housing the mechanism;

a latchbolt mounted to said first, frame means for movement relative thereto between a first, latched position in extension, outwardly, from said frame means, and a second, unlatched position retracted, and substantially confined within said frame means;

second, linkage means, manually-actuated, having (a) a linkage coupled to said latchbolt, and mounted to said first, frame means for movement relative to, and only lengthwise of said frame means, for moving said latchbolt from said first position to said second position, and (b) an arm pivotally mounted to said frame means, and coupled to said linkage, for moving said linkage lengthwise of said frame means;

blocking means mounted to at least one of said first and second frame and linkage means, and movable relative to one of said first and second means (a) for obstructing movement of said linkage means, in a first disposition of said blocking means, and (b) for unobstructing movement of said linkage means, in a second disposition of said blocking means; and release means mounted to said first, frame means and operative in response to, and with a specific time delay following, manual actuation of said linkage means, for moving said blocking means from said first disposition thereof to said second disposition thereof.

19. A panic exit device, according to claim 18, wherein:

said blocking means comprises an abutment mounted to said frame means, and an element movably mounted to said linkage means for abutting engagement with said abutment.

20. A panic exit device having an exit-delaying mechanism, comprising;

first, frame means for housing the mechanism;

a latchbolt mounted to said first, frame means for movement relative thereto between a first, latched position, and a second, unlatched position;

second, linkage means, manually-actuated, linked to said latchbolt, and movably mounted to said first, frame means, for moving latchbolt from said first position second position;

blocking means mounted to at least one of said first and second frame and linkage means, and movable relative to one of said first and second means (a) for obstructing movement of said linkage means, in a first disposition of said blocking means, and (b) for unobstructing movement of said linkage means, in a second disposition of said blocking means; and release means mounted to said first, frame means and operative in response to, and with a specific time delay following, manual actuation of said linkage means, for moving said blocking means from said first disposition thereof to said second disposition thereof; wherein said blocking means comprises an abutment mounted to said frame means, and an element movably mounted to said linkage means for abutting engagement with said abutment;

said linkage means has a bracket fixed thereto;

said element comprises a roller slidably supported in said bracket; and further including means disposed in said bracket, and engaging said roller, biasingly restraining said roller in engagement with said abutment.

21. A panic exit device, according to claim 19, wherein:

said release means comprises means engaged with said element, and translatable relative to said frame means, for moving said element out of engagement with said abutment.

22. A panic exit device having an exit-delaying mechanism, comprising:

first, frame means for housing the mechanism;

a latchbolt mounted to said first, frame means for movement relative thereto between a first, latched position, and a second, unlatched position;

second, linkage means, manually-actuated, linked to said latchbolt, and movably mounted to said first, frame means, for moving said latchbolt from said first position to said second position;

blocking means mounted to at least one of said first and second frame and linkage means, and movable relative to one of said first and second means (a) for obstructing movement of said linkage means, in a first disposition of said blocking means, and (b) for unobstructing movement of said linkage means, in a second disposition of said blocking means; and release means mounted to said first, frame means and operative in response to, and with a specific time delay following, manual actuation of said linkage means, for moving said blocking means from said first disposition thereof to said second disposition thereof; wherein said blocking means comprises an abutment mounted to said frame means, and an element movably mounted to said linkage means for abutting engagement with said abutment;

said release means comprises means engaged with said element, and translatable relative to said frame means, for moving said element out of engagement with said abutment;

said element moving means comprises a limb slidable upon said element;

said element is slidably supported in a bracket;

said bracket is fixed to said linkage means; and said limb is movable through said bracket to displace said element.

23. A panic exit device, according to claim 22, wherein:

said limb has a ramped leading end which movably intrudes between said element and said bracket.

24. A panic exit device having an exit-delaying mechanism, comprising:

first, frame means for housing the mechanism;

a latchbolt mounted to said first, frame means for movement relative thereto between a first, latched position, and a second, unlatched position;

second, linkage means, manually-actuated, linked to said latchbolt, and movably mounted to said first, frame means, for moving said latchbolt from said first position to said second position;

blocking means mounted to at least one of said first and second frame and linkage means, and movable relative to one of said first and second means (a) for obstructing movement of said linkage means, in a first disposition of said blocking means, and (b) for unobstructing movement of said linkage means, in a second disposition of said blocking means; and release means mounted to said first, frame means and operative in response to, and with a specific time delay following, manual actuation of said linkage means, for moving said blocking means from said first disposition thereof to said second disposition thereof; wherein said blocking means comprises an abutment mounted to said frame means, and an element movably mounted to said linkage means for abutting engagement with said abutment;

said release means comprises means engaged with said element, and translatable relative to said frame means, for moving said element out of engagement with said abutment; and said element moving means comprises a limb slidable upon said element, and a solenoid with a bar inductively movable therein, and said limb is coupled to said bar for coincident movement thereof with said bar.

25. A panic exit device, according to claim 24, wherein:

said solenoid has a first, energized mode of operation, and a second de-energized mode of operation; and said solenoid, in one of said modes of operation moves said limb to cause said limb to move said element out of engagement with said abutment.

26. A panic exit device having an exit-delaying mechanism, comprising:

a frame;

a latchbolt mounted to said frame for movement relative thereto between a first, latched position, and a second, unlatched position;

manually-actuated linkage means, linked to said latchbolt and movably mounted to said frame, for moving said latchbolt from said first position to said second position;

first means mounted to said frame, and movable relative to said frame between a first disposition thereof (a) for obstructing movement of said linkage means, and a second disposition thereof (b) for unobstructing movement of said linkage means; and second means mounted to said frame operative in response to, and with a specific time delay following, manual actuation of said linkage means, for moving said first means from said first disposition thereof to said second disposition thereof; wherein said linkage means comprises dampening means for absorbing excessive manual force applied to said linkage means in actuation thereof.

27. A panic exit device having an exit-delaying mechanism, comprising:

first, frame means for housing the mechanism;

a latchbolt mounted to said first, frame means for movement relative thereto between a first, latched position, and a second, unlatched position;

second, linkage means, manually-actuated, linked to said latchbolt, and movably mounted to said first, frame means, for moving said latchbolt from said first position to said second position;

blocking means mounted to at least one of said first and second frame and linkage means, and movable relative to one of said first and second means (a) for obstructing movement of said linkage means, in a first disposition of said blocking means, and (b) for unobstructing movement of said linkage means, in a second disposition of said blocking means; and release means mounted to said first, frame means and operative in response to, and with a specific time delay following, manual actuation of said linkage means, for moving said blocking means from said first disposition thereof to said second disposition thereof; wherein said second, manually-actuated linkage means comprises means for absorbing excessive manual force applied to said linkage means in actuation thereof.

28. A panic exit device, according to claim 26, wherein:

said dampering means comprises an extension spring.

29. A panic exit device, according to claim 27, wherein:

said absorbing means comprises an extension spring.

30. A panic exit device, according to claim 1, wherein:

said arm is pivotably mounted, as aforesaid, for movement through a given arc; and said first means comprises an element which normally intrudes into said arc to prevent pivotable movement of said arm therethrough.

* * * * *